United States Patent [19]

Tornegård

[11] 4,139,141

[45] Feb. 13, 1979

[54] METHOD AND APPARATUS FOR MANUFACTURE OF SPIRALS WITHOUT AXLE

[75] Inventor: Olle Tornegård, Malmö, Sweden

[73] Assignee: Aktiebolaget Platmanufaktur, Malmö, Sweden

[21] Appl. No.: 809,983

[22] Filed: Jun. 27, 1977

[30] Foreign Application Priority Data

Jun. 30, 1976 [SE] Sweden ..... 7607444

[51] Int. Cl.[2] ..... B21D 11/06; B23K 31/02

[52] U.S. Cl. ..... 228/173 R; 228/182; 72/142

[58] Field of Search ..... 228/173 R, 173 C, 182, 228/183, 15.1, 17; 72/135, 136, 142, 143; 29/157.3 AH

[56] References Cited

U.S. PATENT DOCUMENTS

| | | | |
|---|---|---|---|
| 1,225,895 | 5/1917 | Turney | 228/183 X |
| 2,669,012 | 2/1954 | Bruegger | 29/157.3 AH |
| 2,800,944 | 7/1957 | Schmeling | 29/157.3 AH |
| 3,464,101 | 9/1969 | Zubal et al. | 72/135 X |
| 3,608,347 | 9/1968 | Kemminer | 72/142 |
| 3,729,968 | 5/1973 | Norris | 72/136 X |

*Primary Examiner*—Al Lawrence Smith
*Assistant Examiner*—K. J. Ramsey
*Attorney, Agent, or Firm*—Hane, Roberts, Spiecens & Cohen

[57] ABSTRACT

A method and apparatus for manufacturing a spiral member by cold working an elongated strip comprising attaching one end of the steel strip to a mounting plate on a rotatable axle and driving the axle in rotation to wind the strip onto the axle to form a spiral member from the strip. The strip is guided as it proceeds for winding on the axle by two spaced guide plates on opposite sides of the strip so that each turn of the strip will lie adjacent the previous turn. The position of the guide plates is adjusted with respect to the winding of the strip along a line which forms an angle with respect to the axis of rotation of the strip. After the formation of the spiral member, it is drawn to a predetermined length.

10 Claims, 3 Drawing Figures

METHOD AND APPARATUS FOR MANUFACTURE OF SPIRALS WITHOUT AXLE

FIELD OF THE INVENTION

The present invention relates to a method for the manufacture of spirals without axle mainly by means of cold-working of steel, primarily special steel, and to a device for carrying out the method.

BACKGROUND OF THE INVENTION

Attempts have been made before to make spirals of special steel without axle, where the process was effected in the form of cold-working. In that connection it has turned out that the methods and devices applied brought about cracking and deformation of the material in the spirals. When attempts have been made to wind the spirals, the up-ended bar or band-like object has been prone to twist in such a way that the longest side of the sectional area of the object has been oriented so that it has become more or less parallel with the axle direction of the spiral formed. As spirals according to the invention are primarily intended for use as spiral conveyors such an orientation of the material in the spiral conveyor formed will obviously cause the desired effect of conveyance to disappear more or less, and therefore the spiral will become unsuitable for the desired purpose.

SUMMARY OF THE INVENTION

The present invention is directed to a method and a device where the drawbacks mentioned above are removed and where spirals of the type desired can easily be made of special steel, even if this is cold. An example of special steel to which the invention can be applied is SIS 2172.

According to the invention, an up-ended object of mainly rectangular cross-section, primarily in the form of a bar or a band, is wound around a winding axle so that the object around the axle forms a spiral. When being wound every turn of the spiral will lie close to the previous turn. The compressed spiral formed in this way will then be stretched out in the direction of the axle until the spiral reaches a predetermined length. This working of the object can take place while the material of the object is cold.

The above method for the manufacture of spirals on the basis of only one object can, in certain applications, have the restriction that the height of the rectangular cross-section of the object cannot be allowed to reach sufficiently high values before the required area of the driving surface of the spiral has been reached when this is to be used as a spiral conveyor. However, the invention turns out to be applicable for the solution of this problem, as the method given above can be applied for the manufacture of two or more spirals which have been dimensioned so that they can be placed inside each other. Through a suitable choice of dimensions for the spirals which are to be coupled together the method makes it possible to manufacture spirals where the respective length and pitch of the spirals are similar for each spiral and where the inside diameter of the large spiral is similar to the outside diameter of the small spiral. Spirals with such properties can then easily be joined, e.g. through welding, and the spiral made up of two spirals in the way described will then have a larger area of conveyance than a spiral made in the manner described in the previous paragraph.

BRIEF DESCRIPTION OF THE DRAWINGS

The invention is described in detail in connection with the three figures of the attached drawings, wherein.

DETAILED DESCRIPTION

Figure 1:
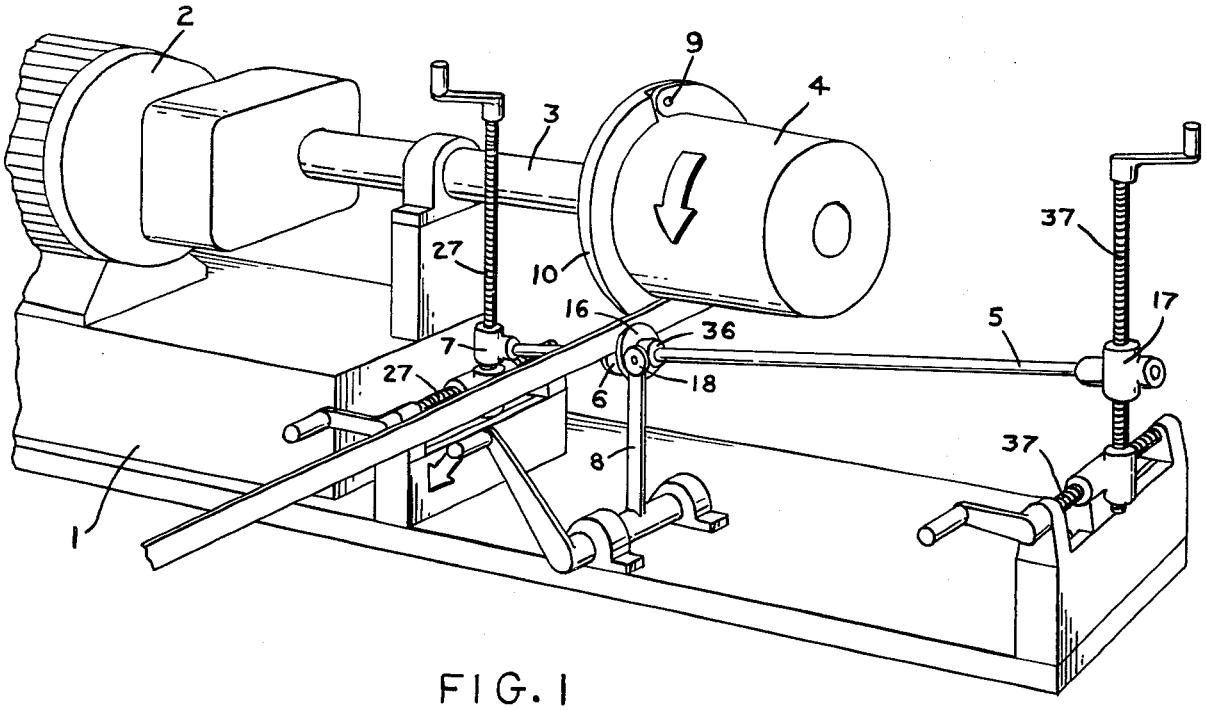
FIG. 1 is a perspective view of a device operating according to the invention.
Figure 2:
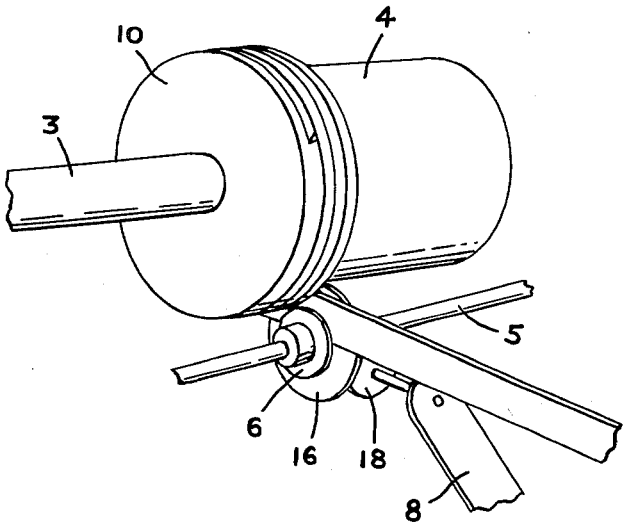
FIG. 2 is a view of a detail of the winding section of the device.

In FIGS. 1 and 2 is seen a frame 1 arranged with a driving mechanism 2 which operates a driving shaft 3, which is arranged with a winding shaft 4. The winding shaft 4 is provided with a supporting flange 10, on which is arranged a draw pin 9. At an angle to the driving shaft 3, and thus to the winding shaft 4, is arranged a guide shaft 5, and therefore the driving shaft has a direction which is mainly in accordance with the direction of the driving shaft 3. The length of the guide shaft 5 is such that it extends past the winding shaft 4, and, furthermore, it is adjustably supported at both ends in a rear suspending device 7 and a front suspending device 17. The suspending devices can be adjusted both horizontally and vertically by means of a rear adjustment device 27 and a front adjustment device 37. On the guide shaft is fitted a thrust roller 36, which thrust roller has been mounted in such a way that it can rotate around the guide shafts and be shifted in the longitudinal direction of the guide shaft. The thrust roller is provided with a front thrust plate 16 and a rear thrust plate 6 arranged at some distance from each other and adapted to the thickness of the object e.g. the elongated strip, which is to be wound. The front thrust plate has a diameter which is larger than the diameter of the rear thrust plate. A thrust wheel 18, which is mounted on backstop 8, fits tightly against the front thrust plate. The thrust wheel 18 fits against the front thrust plate 16 in such a way that it can rotate when the thrust plate rotates.

Figure 3:
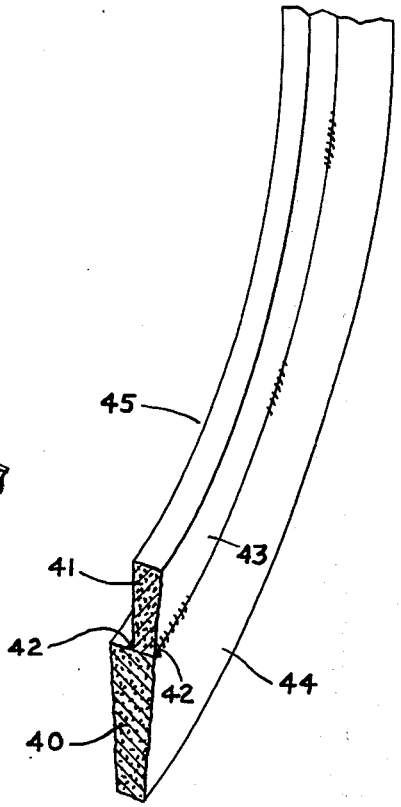
FIG. 3 is a perspective view, in section, of a spiral joined together from two initial spirals.

In FIG. 3 is seen a spiral 45, which has been formed by a larger spiral 40 to which is joined to a smaller spiral 41. The two spirals are fastened to each other in such a way that the two side surfaces 43, 44 of the spirals are flush with each other. The connection between the spirals can be made up of welds 42. The two surfaces which are arranged flush with each other form the driving surface of the spiral 45. The figure shows clearly how a primarily rectangular object, which has been formed into a spiral with the device working according to the invention, during its shaping takes up a cross-section where one short side is longer than the other.

The device for carrying out the method according to the invention operates in the following manner.

An object of rectangular cross-section is fastened to the draw pin 9 by means of a hole in one end of the object. The thrust roller 36 is led into such a position that the front thrust plate 16 lies true against one side of the object, and the rear thrust plate 6 against the other side of the object. Thus the object has been up-ended, which means that one of its short sides is turned against the winding axle 4. By means of the driving device 2 and the driving shaft 3 the winding axle 4 is turned, along with the supporting flange 10 with its draw pin 9, and thus the object will follow their movement. During this movement the object is guided by the front and the rear thrust plates so that it fits tightly against the supporting flange 10 during the initial steps of the winding of the object. The supporting flange 10 is arranged at a spacing corresponding to the thickness of the object used, which has the effect that when the object has been wound one revolution, it will during continued winding lie true against the first turn wound. At the same time the object will be moved in the direction of the winding axle during the winding operation. The thrust roller 36 will follow the axial movement. The purpose of the thrust roller is to give the object the correct direction to enable it to lie true against the supporting flange 10 or against earlier wound turns of the object. The front thrust plate and the rear thrust plate lie true against the two broad sides of the object, as mentioned before, and in this way they ensure that the above-mentioned desired direction of the object is acquired. At the same time the movement of the thrust roller 36 is effected in the axial direction of the guide shaft by the thrust wheel 18, so that the movement of the thrust roller in the mentioned axial direction is only allowed to the extent which is required to enable every new turn to lie true against the previous turn in connection with the winding of the object. The exact direction of the rear thrust plate 6 and the front thrust plate 16, and thus of the object, is determined by the direction of the guide shaft 5. The direction of this shaft can be adjusted by means of the adjustment of the front suspending device 17 and the rear suspending device 7.

The direction and position of the guide shaft 5 in relation to the winding shaft 4 will completely determine the result of the winding. Only if the shaft and thus the thrust plates are correctly set will the object acquire such a direction during the winding operation that the wound turns remain up-ended around the winding shaft 4. The dimensions of the object used and the properties of the material of the object will determine the distance between the guide shaft 5 and the winding shaft 4, and the angle which the two shafts form to each other.

A spiral made in the manner mentioned above will then be fastened in both ends in a pulling device, and then it will be pulled to a predetermined length. In this way the diameter of the spiral is decreased and at the same time the individual turns in the spiral are twisted somewhat, so that the surfaces of the broad sides of the spiral assume a direction which is suitable for the use of the spiral as a spiral conveyor.

In the cases where a larger surface is required for the spiral conveyors than the surface which can be obtained for spirals made of only one object in accordance with what has been described above, spirals of the required dimensions are made by manufacturing a number of spirals. These spirals are then adapted to each other so that in a large spiral the inside diameter exactly corresponds to the outside diameter of a small spiral, and so that the two spirals have exactly the same pitch. The fact is that it is fairly simple in advance to calculate the dimensions for the starting objects in order to make the adaption of the spirals possible. The only thing required in the manufacture of the spirals is that they are pulled to the correct length. In this way the requirements of similar inside diameter and outside diameter and of similar pitch will have been met. The joining of spirals put together in this way can take place by means of, for instance, welding, as has already been mentioned in connection with FIG. 3.

A great advantage of the use of the method according to the invention is that devices for the manufacture of spirals can be made very simple, and at the same time they are easy to adapt to different dimensions of spirals. Devices according to the invention will also make it possible to manufacture spirals without any pre-heating whatsoever even in cases where the material of the spirals is of relatively hard steel, i.e. special steel.

I claim:

1. A method of manufacturing a spiral member by cold working an elongated steel strip said method comprising attaching one end of the steel strip to a rotatable axle, driving the axle in rotation to wind the strip on the axle to form a spiral member from said strip, guiding said strip, as it proceeds for winding on said axle, by two spaced guide plates on opposite sides of the strip, so that each turn of the strip will lie adjacent the previous turn, adjusting the position of the guide plates with respect to the winding of the strip along a line which forms an angle with respect to the axis of rotation of the axle, and drawing the formed spiral member axially to a predetermined length.

2. A method as claimed in claim 1 wherein two spiral members are formed of similar length and pitch, said spiral members being joined together by placing one within the other and securing them together.

3. A method as claimed in claim 2 wherein said spiral members are secured by welding.

4. A method as claimed in claim 3 wherein said spiral members are joined so as to place their surfaces flush with one another.

5. A method as claimed in claim 1 wherein the angle between the line of the guide plates and the axis of the rotation of the axle is between 2 and 5°.

6. A method as claimed in claim 5 comprising adjusting said angle in accordance with the hardness of the steel of the strip.

7. Apparatus for cold working an elongated steel strip to form a spiral member, said apparatus comprising a frame, a winding shaft, means supporting said winding shaft from said frame for driving said shaft about an axis of rotation, said winding shaft including a mounting flange thereon, a guide shaft mounted adjacent said winding shaft and extending at an angle relative thereto, guide means in said guide shaft for guiding the travel of an elongated strip which is wound on said winding shaft, means on said mounting flange for attaching one end of said strip thereto for winding of the strip on said winding shaft, and means supporting said guide means for axial adjustment movement on said guide shaft, said guide means including a pair of spaced guide plates disposed on opposite sides of the path of travel of the strip for engaging opposite surfaces thereof.

8. Apparatus as claimed in claim 7 wherein said guide means comprises a thrust roller rotatably supported on said guide shaft.

9. Apparatus as claimed in claim 7 comprising means supporting said guide shaft at two axially spaced locations for vertical and horizontal movement.

10. Apparatus as claimed in claim 7 comprising thrust means acting on said guide means for holding said guide plates against said strip during travel of the strip for winding thereof on said winding shaft so that each winding lies adjacent the previous winding.

* * * * *